US005629672A

United States Patent [19]

Brown et al.

[11] Patent Number: 5,629,672

[45] Date of Patent: May 13, 1997

[54] LOW PAPER DETECTION SYSTEM

[75] Inventors: Stephen S. Brown, Plymouth; David E. Falkner, Blaine, both of Minn.

[73] Assignee: Gift Certificate Center, Inc., Minneapolis, Minn.

[21] Appl. No.: 495,285

[22] Filed: Jun. 27, 1995

[51] Int. Cl.[6] ..... G08B 21/00

[52] U.S. Cl. ..... 340/540; 340/568; 340/600; 340/612; 340/679; 399/23

[58] Field of Search ..... 340/540, 612, 340/600, 679, 568; 355/205

[56] References Cited

U.S. PATENT DOCUMENTS 4,928,949 5/1990 Ramsey et al. ..... 271/111
5,365,311 11/1994 Matsuoka ..... 340/679

*Primary Examiner*—Glen Swann
*Attorney, Agent, or Firm*—Patterson & Keough, P.A.

[57] ABSTRACT

An improved paper image reproduction device being communicatively integrated into a communications network and having a cabinet having at least one cassette receiver for receiving a paper cassette and a paper cassette paired with each such paper cassette receiver, the paper cassette bearing a supply of stacked paper sheets, includes a detector disposed with the cabinet for sensing a partial supply of paper in each such paper cassette. A signal generator is coupled to the detector and is communicatively coupled to the communications network for providing a signal to the local area network representative of a partial supply of paper in each such paper cassette. The local area network communicates such signal to at least one station on the communications network.

21 Claims, 6 Drawing Sheets

10
16
14
14
24
12
20
22
18

LOW PAPER DETECTION SYSTEM

TECHNICAL FIELD

The present invention relates to a paper supply "low" detection system for use with a supply sheet paper in a tray cassette that is utilized with an image reproduction device. More particularly, the paper "low" detection system is coupled to a local or wide area network to provide an indication of a low paper condition to a user or users that are in communication with the network.

BACKGROUND OF THE INVENTION

There is a growing use of image reproduction devices and printers, primarily laser printers, that are integrated into a computer network. Computer networks are now common in many businesses and may extend over several floors of a building facility and may have many users sharing a plurality of printers. In many installations, several of the printers that are connected to the network are located on each floor of the facility that is served by the network.

Alternatively, numerous printers connected to a computer network may be widely scattered in individual kiosks located throughout a mall type retail outlet. Such printers are typically located in the kiosks that offer a particular service and that dispense printed paper responsive to a customer's inputs at the printer site. The various printers are typically monitored at a central location located somewhere within the mall. Additionally, such kiosks may be distributed nationwide and connected through a wide area communications network to a central monitoring location, which is located at great distance from the majority of the kiosks. In this case, the paper "low" signal would prompt an operator at the central location to call the retail store where the kiosk is located to have the store personnel replenish the paper supply. In more remote locations, a kiosk service provider would be dispatched to refill the paper.

It is imperative that the printers always have a supply of paper in order to respond to the customer request. An exhausted paper supply results in the kiosk being off-line and, consequently, results in a lost sale. Typically, a person in a retail outlet that is located proximate to the kiosk is detailed to ensure that the paper supply is adequate. Preferably, such person is notified of a paper "low" condition after or before normal working hours so that replenishing the supply does not interfere with the normal activities associated with the retail outlet. It would be advantageous to decrement the number of paper sheets remaining in the cassette after initiation of a paper "low" signal so that the remaining supply could be monitored and could be replenished during normal working hours if the kiosk was experiencing an abnormally high demand and the paper supply was about to be exhausted.

Presently, printers typically have paper "out" quantity detectors only. Since the printers are closely operated, a paper "out" signal is adequate to indicate to a nearby operator that paper needs replenishing. Accordingly, most commercially available printers today have only a paper "out" detector.

With networks as have been described, a paper "out" signal indicating exhaustion of the paper supply in a particular printer is typically the only indication available that reflects the status of the paper supply. Such a signal by itself is simply not adequate for the aforementioned scenarios. A paper "low" signal, indicating that a preselected quantity of paper sheets remain in the printer, is needed so that the supply can be replenished in a timely manner and to ensure that the printer is available for use the maximum possible time. Also, decrementing the number of sheets remaining after detecting a paper "low" condition is desirable in order to trigger resupply of paper when exhaustion of the current supply is imminent.

Printers today typically draw paper from a stacked supply of paper sheets as distinct from a continuous roll of supply paper. The stacked paper sheets are loaded into a tray type cassette. In order to replenish the supply of paper sheets in such a cassette, the cassette is typically fully removed from the printer cabinet. It is important that a paper "low" detector be installed in such a manner as to not impair the ability to fully remove the cassette from the printer. Accordingly, the "low" paper detector should be located within the printer cabinet, but remote from the cassette in order to facilitate freely removing the cassette from the printer cabinet.

Additionally, it is desirable that a detector take advantage of the inherent reliability in electro optical technology as distinct from a purely mechanical detector or a mechanical/optical detector. This is especially true for the remotely located printers in the kiosks. Maintenance of such printers should a detector malfunction is not typically readily available. The paper "low" sensor should have a range of settings so that a selected quantity of paper remaining, e.g. 100 sheets or 200 sheets, may be detected as desired. Since there are a great many printers currently on the market, it is desirable that the paper "low" detector be configured to be able to be readily retrofitted into such existing printers. It is desirable that such retrofit not require physical alteration of the existing tray cassettes.

The Japanese reference 0062136 discloses a tray cassette having a paper "low" detector physically attached to the cassette. The paper "low" detector utilizes an illuminator in a vertically stacked array of optical fibers. Both the illuminator and the stacked array of optical fibers have physically attached to the cassette. Removal of the cassette from the printer cabinet is hampered by the extensive number of fiber optic and electrical connections that exist between the tray cassette and the printer cabinet.

A second paper "low" detector is presented in U.S. Pat. No. 4,928,949. The '949 patent discloses an illuminator and an optical receiver disposed below and above the stack of supply paper respectively. The paper in the particular cassette of the '949 patent is stacked at an acute angle. The detector relies on the depletion of a portion of the angularly stacked paper in order for the detector to detect the light transmission by a sensor that is positioned on an opposite side of the paper stack from the emitter and to register a paper "low" condition.

SUMMARY OF THE INVENTION

The present invention substantially meets the needs expressed above. The paper "low" detector utilizes electro optical technology. The detector is mounted in the rear wall of the receiver within the printer cabinet that supports the tray cassette. No modification of certain existing tray cassettes is required and no components of the detector are mounted on the cassette itself that would inhibit the free removal of the cassette from the printer cabinet receiver. The detector is adjustable in position relative to the tray cassette in order to selectively determine the amount of paper remaining required to initiate a paper "low" signal. The detector is capable of being readily retrofitted into the receivers of existing printers.

The present invention comprises an improved paper image reproduction device that is communicatively integrated into a local area network. The paper image reproduction device has a cabinet having at least one cassette receiver for receiving a paper cassette and a paper cassette paired with each such paper cassette receiver. The paper cassette bears the supply of stacked paper sheets. The paper image reproduction device includes a detector disposed with the cabinet for sensing a partial supply of paper in each such paper cassette. A signal generator is coupled to the detector and is communicatively coupled to the local area network for providing a signal to the local area network representative of a partial supply of paper in each such paper cassette. The local area network communicates such signal to at least one station on the local area network.

DETAILED DESCRIPTION OF INVENTION

Figure 1:
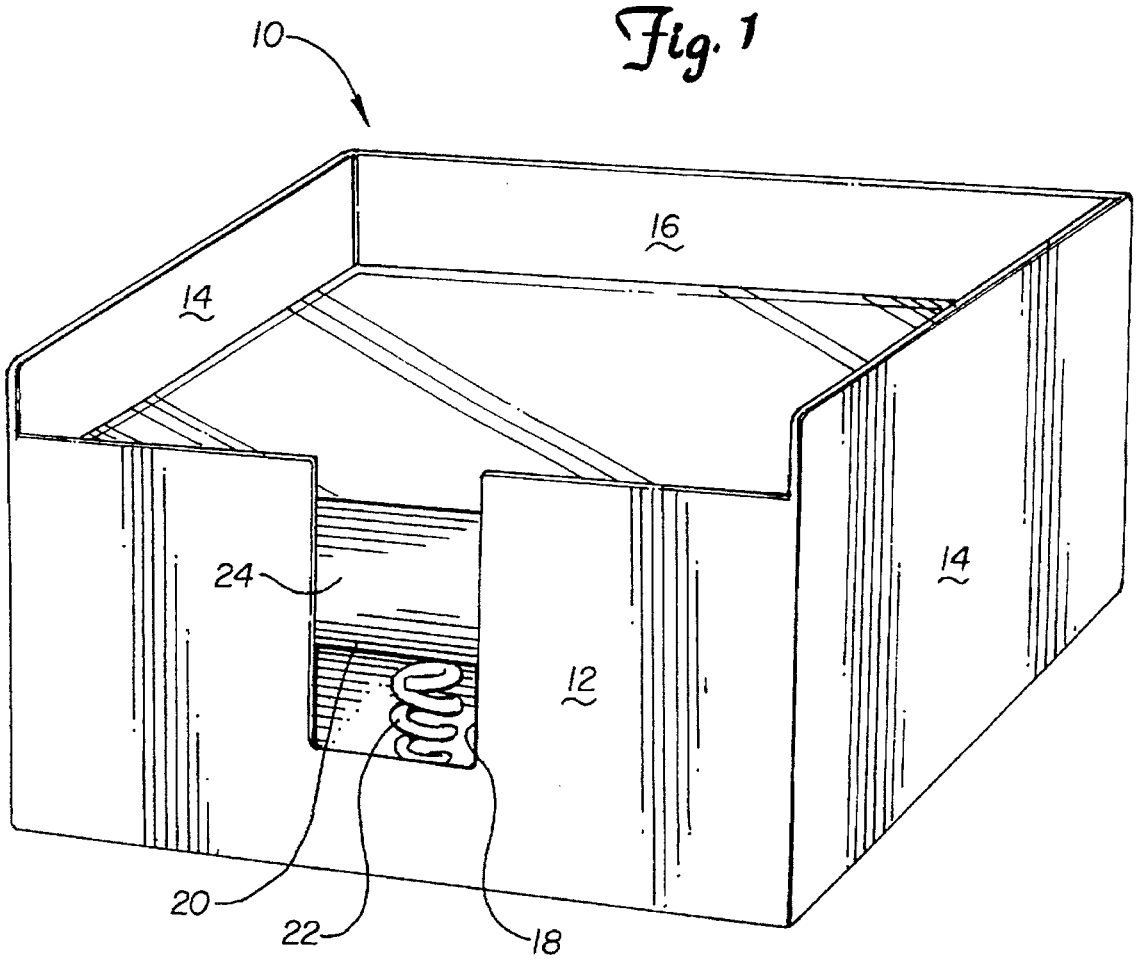
FIG. 1 is a rear prospective view of a typical paper cassette as used in a printer.

A typical paper cassette is shown generally at 10 in FIG. 1. The paper cassette 10 is preferably formed of a plastic material. The paper cassette 10 is generally formed in a rectangular shape with an open upper portion that facilitates the removal and resupply of the stack of paper sheets.

The paper cassette 10 has a rear wall 12, two opposed side walls 14, and a front wall 16. A slot 18 is formed in the rear wall 12.

A translatable paper tray 20 is disposed within the paper cassette 10. The paper tray 20 is urged in an upward direction, as depicted in FIG. 1, by the biassing action of spring 22. The paper supply 24 of the paper cassette 10 is supported by the tray 20 and confined within the rear wall 12, the opposed side walls 14, and the front wall 16.

Figure 2:
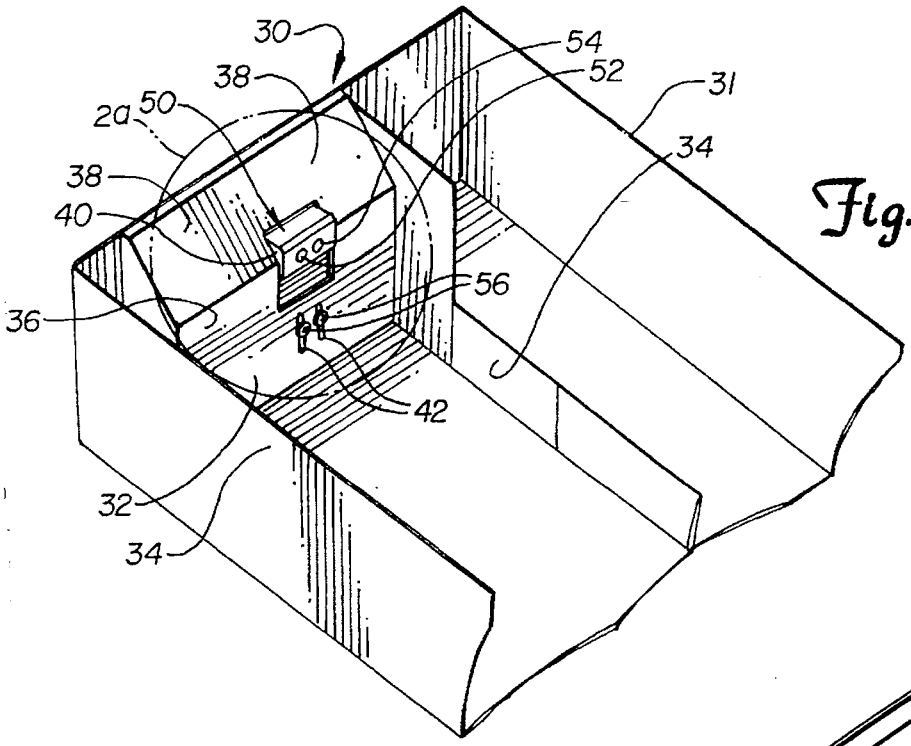
FIG. 2 is a paper cassette receptacle of a paper printer having the paper "low" detector of the present invention installed therein.

The paper cassette 10 is slidably received within a printer cassette receiver 30 that is a portion of the printer cabinet 31, as is depicted in FIG. 2. The interior dimensions of the printer cassette receiver 30 are slightly greater than the exterior dimensions of the paper cassette 10 in order to receive the paper cassette 10 therein.

The printer cassette receiver 30 has a rear wall 32 and two opposed sidewalls 34. When the paper cassette 10 is fully installed within the printer cassette receiver 30, the rear wall 12 of the paper cassette 10 abuts the rear wall 32 of the printer cassette receiver 30.

The rear wall 32 of the printer cassette receiver 30 has a vertical rear wall portion 36 and a canted rear wall portion 38. A detector aperture 40 is formed to intersect the vertical rear wall portion 36 and the canted rear wall portion 38. A pair of oval slots 42 are formed beneath the detector aperture 40. The detector 50 is disposed in the detector aperture 40. The detector aperture 40 and the pair of oval slots 42 may be formed in the rear wall 32 at the time of manufacture thereof or may be cut into the rear wall 32 at some later time when retrofitting the printer to provide the paper "low" indication capability. The relative simplicity of forming the detector aperture 40 and the pair of oval slots 42 in the rear wall 32 of the printer cassette receiver 30 after the printer has been manufactured makes retrofitting the detector 50 to the printer very easy. This is a decided advantage of the present invention since so many printers are presently on the market that would be significantly enhanced by retrofitting the present invention therein.

Figure 2A:
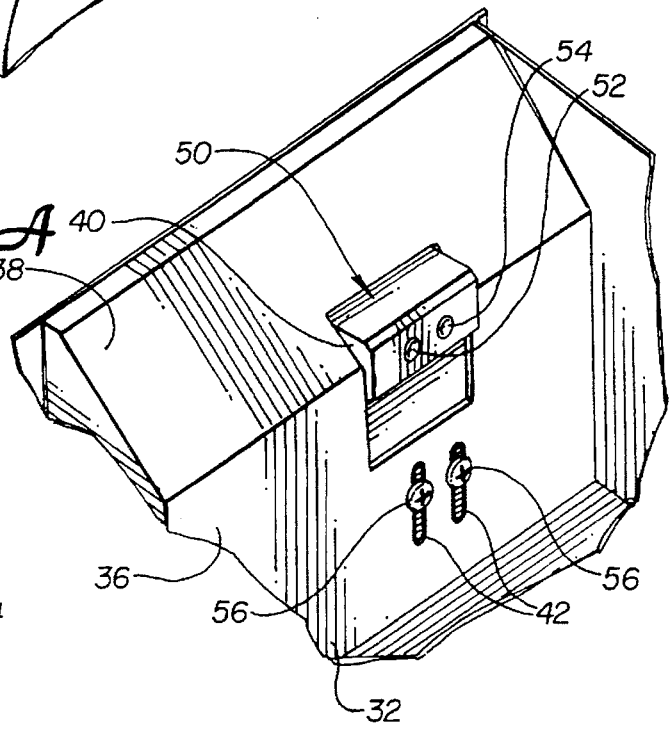
FIG. 2*a* is an enlarged prospective view of the portion of FIG. 2 within circle 2*a* of the paper "low" detector of FIG. 2.
Figure 3:
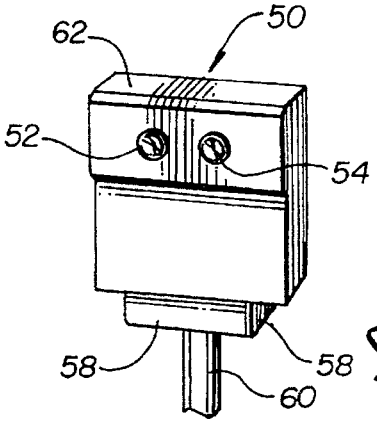
FIG. 3 is a front perspective view of the paper "low" detector.

Referring to FIGS. 2 and 2*a*, detector 50 is disposed within the aperture 40. The detector 50 preferably has a light emitter 52 and a light sensor 54. Mounting screws 56 are passed through the oval slots 42 and engage the mounting screw bores 58, as depicted in FIG. 3. The head of the mounting screws 56 engages the edge portion of the oval slots 42, thereby fixably positioning the detector 50 within the detector aperture 40. The height of the detector 50 relative to the bottom of the printer cassette 20, can be adjusted within the range afforded by the oval slots 42. As will be appreciated by those skilled in the art, the dimensions and location of the detector aperture 40 and the pair of oval slots 42 are dictated by the configuration of the selected detector 50 that is to be used.

The preferred detector 50 is a model SE612D sensor made by Banner Engineering Corporation, 9714 Tenth Avenue North, Minneapolis, Minn. 55441. As will be appreciated by those skilled in the art, other suitable sensors may be used for detector 50. The model SE612D sensor is a miniature modulated DC sensor that is constructed in a molded plastic housing. The sensor conducts when the light sensor 54 senses the reflected light emitted by the light emitter 52. Alternatively, the sensor can be configured to conduct when the light sensor 54 does not sense the reflected light emitted by the light emitter 52.

Figure 5:
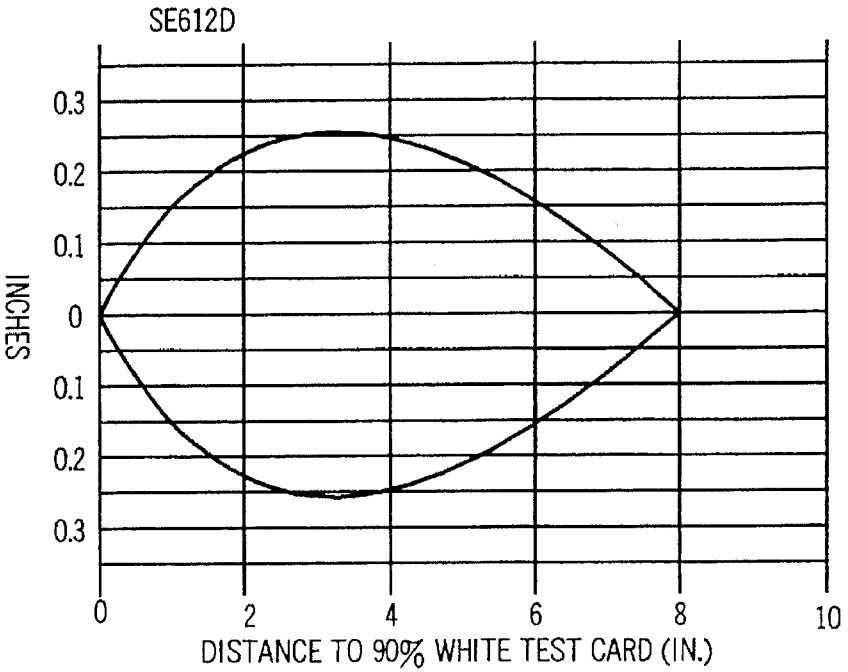
FIG. 5 is a graph of the beam pattern of the paper "low" detector.
Figure 4:
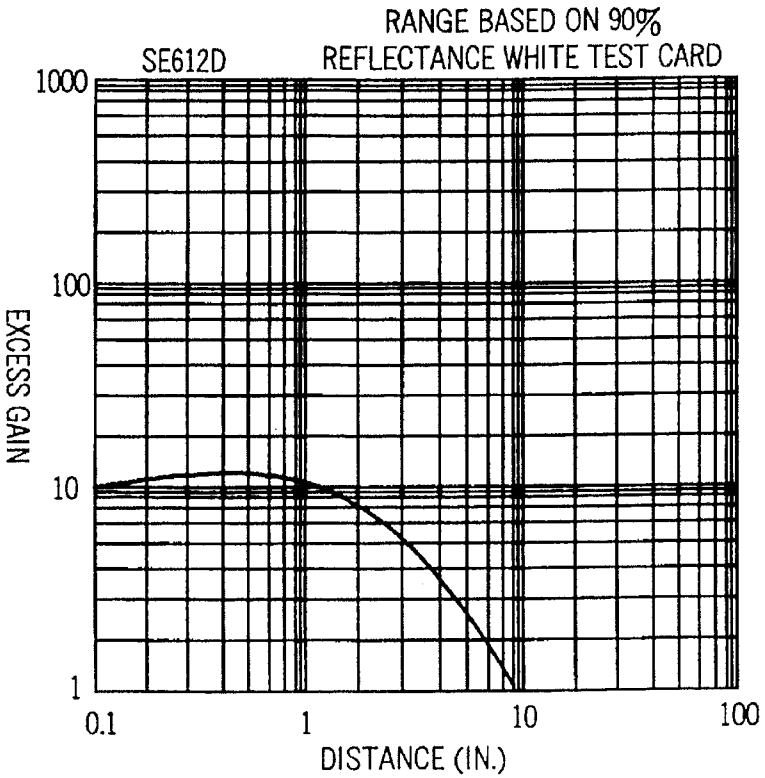
FIG. 4 is a logarithmic graph of distance versus excess gain for the paper "low" detector.

Such sensors detect objects by sensing their own emitted light reflected from the object. As indicated in FIG. 4, the excess gain of the model SE612D falls off sharply beyond one inch. As a result, the SE612D is useful when it is necessary to ignore background objects, as in the present application. When the tray 20 rises above the level of the light emitter 52 and the light sensor 54, the beam from the light emitter 52 is directed to the area beneath the tray 20 and any components located therein. A longer range type of detector 50 may result in a received light reflection from the components, which would result in false indication that the edges of the paper sheets of the paper supply 24 was still being illuminated and detected. FIG. 5 illustrates the beam pattern of the model SE612D and indicates that the range is limited to eight inches.

Returning to FIG. 3, the detector 50 has a lead 60 that communicatively couples the detector 50 to the local area network. The lead 60 has conductors 61, providing a plus 10 to 30 Vdc input, a positive-going sourcing output, a negative-going sinking output, and a common lead. An indicator light 62 is illuminated when the detector 50 is conducting.

Figure 6:
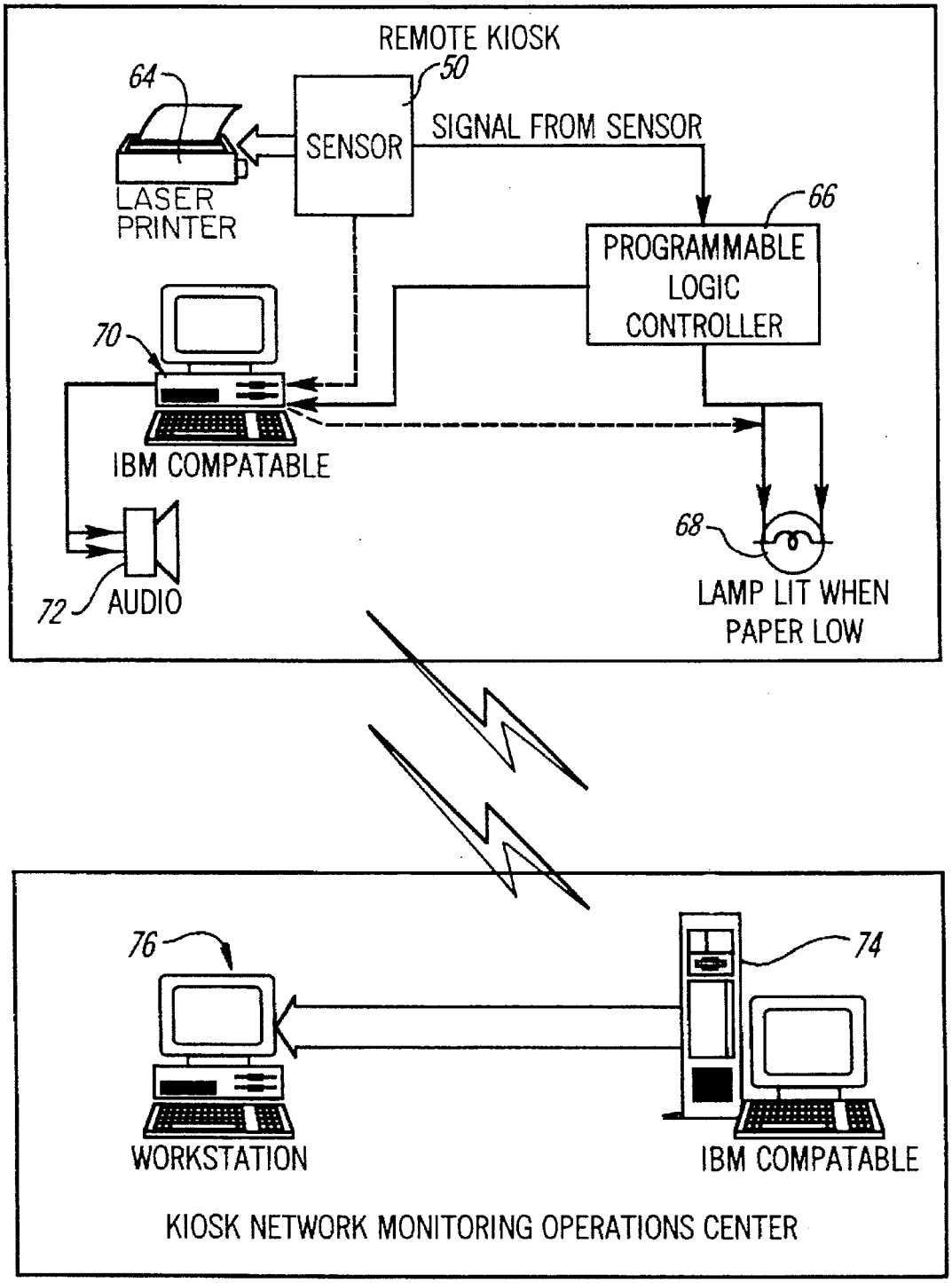
FIGS. 6, 6*a*, & 6*b* are schematic representations of the paper "low" detector integrated into a local area network.

Referring to FIG. 6, the detector 50 is depicted integrated into a local area network. In a preferred embodiment where multiple printers 64 are disposed at remote sites, the detector 50 within the printer 64 provides a paper "low" indication to the programmable logic controller (PLC) 66.

The programmable logic controller 66 performs the function of transposing direct current output signal from the detector 50 to a digital format. The digitally formatted paper "low" signal is provided to the computer 70. The computer 70 displays a suitable paper "low" indication on the screen thereof. Additionally, the computer 70 may provide an audio indication of a paper "low" condition by activating audio indicator 72. Either the computer 70 or the programmable logic controller 66 may light an indicator lamp 68 when a paper "low" condition exists.

Figure 6A:
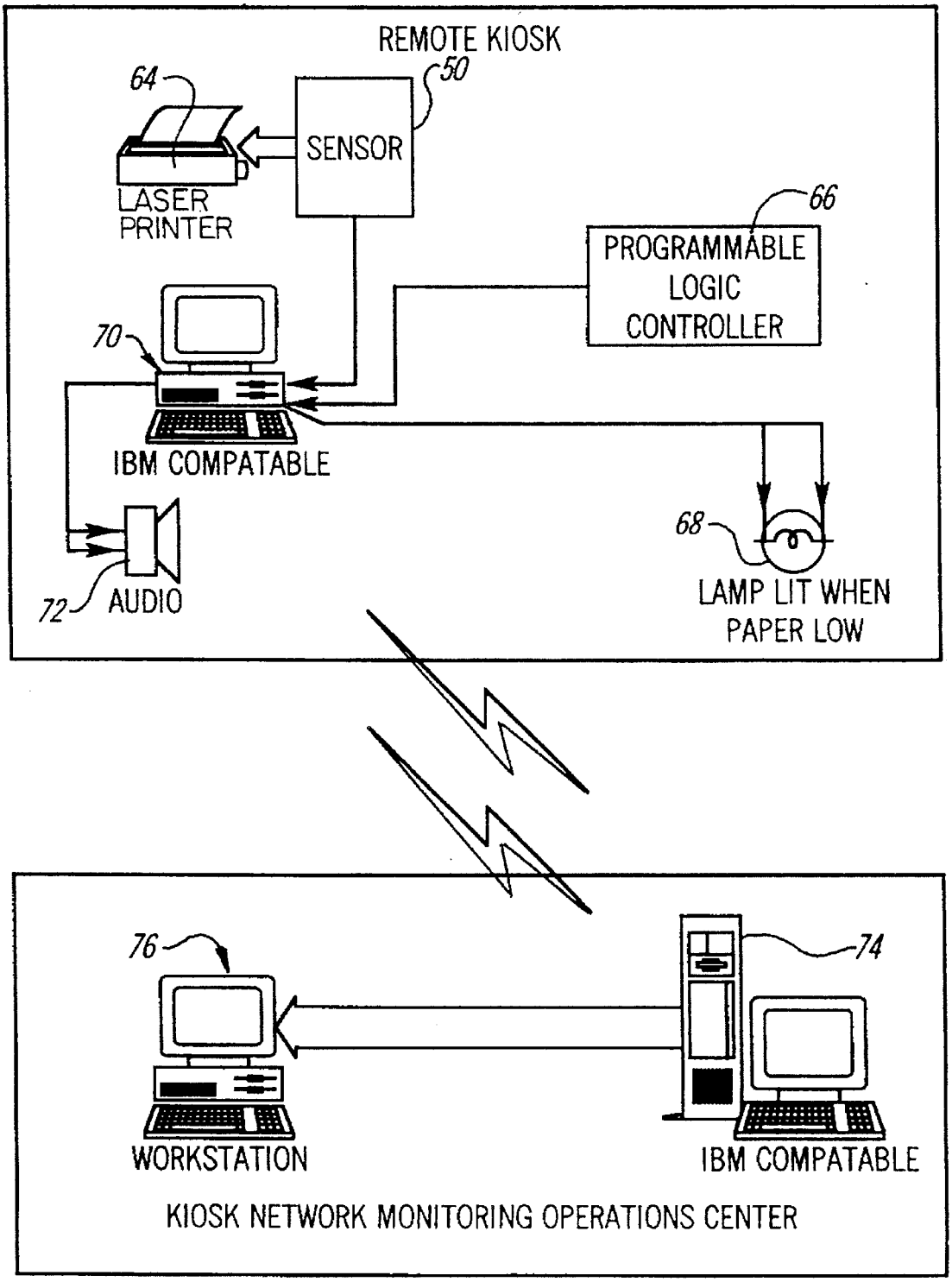

In an alternative embodiment depicted in FIG. 6*a*, the analog to digital conversion of the paper "low" signal may be performed by the computer 70. In such embodiment, there is no need for use of the programmable logic controller 66 in presenting the paper "low" signal to an operator.

Figure 6B:
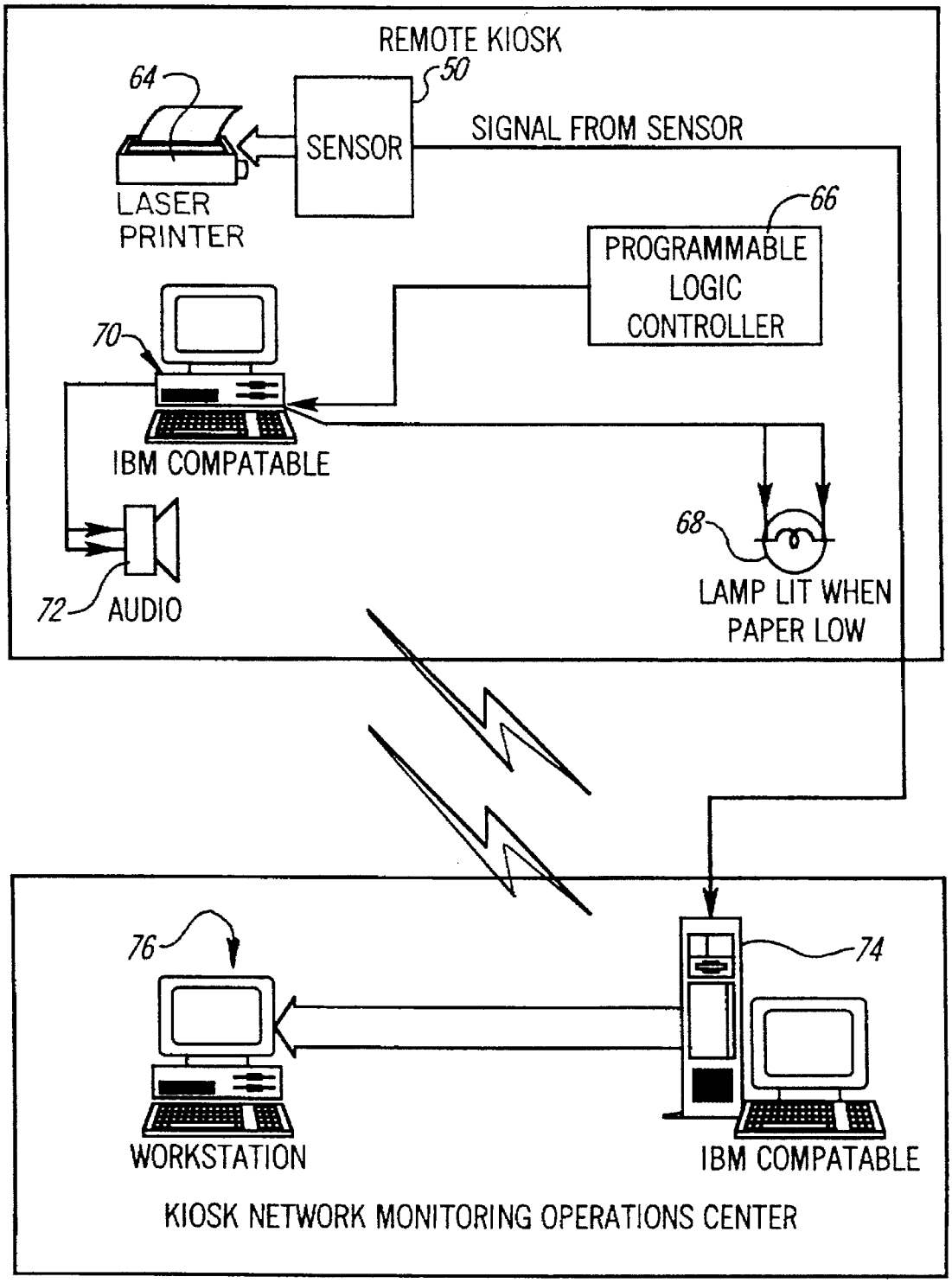

In a further alternative embodiment depicted in FIG. 6*b*, the "low" paper signal from the detector 50 is provided directly to the network controller 74. The network controller 74 then provides the paper "low" indication to one or more work stations 76.

In operation, the paper cassette 10 is fully removed from the printer 64 for resupplying with a stack of paper sheets. In a preferred paper cassette 10, a full load of paper may include as much as 500 sheets of paper, however, fully resupplying the cassette 10 is not necessary to the functioning of the "low" paper detector 50 the present invention. The paper "low" indication is not dependant on knowing the starting point of the quantity of the paper supply 24 in order to provide an accurate determination of the remaining paper supply 24.

As the paper supply 24 is placed within the paper cassette 10, the tray 20 is depressed, thereby compressing spring 22. With the paper supply 24 replenished, the paper cassette 10 is placed back into the printer 64. In the installed position of the paper cassette 10, the rear wall 12 of the paper cassette 10 is flush with the rear wall 32 of the printer cassette receiver 30. The detector 50, disposed within the detector aperture 40 is aligned with slot 18 of the paper cassette 10. Accordingly, with a full paper supply, light from the light emitter 52 is reflected off the edges of the paper sheets and received by the light sensor 54.

The upward bias of the spring 22 acting upon the tray 20 holds the top sheet of the paper supply 24 in contact with a feed roller (not shown). Revolution of the feed roller strips the top sheet of paper off the paper supply 24. As the paper supply 24 is diminished, spring 22 acts upon tray 20 in an upward direction to keep the top sheet of the paper supply 24 against the roller.

The detector 50 is positioned with respect to the rear wall of the printer cassette receiver 30 such that when there are a selected number of sheets of paper remaining in the paper supply 24, the tray 20 rises above the level of the light emitter 52 and light sensor 54 of the detector 50. At such point, the light emitted from light emitter 52 is no longer detected by light sensor 54. This is partially due to the very limited range of the detector 50, such that components that are located below the tray 20 are not detected by the detector 50. This condition constitutes the paper "low" signal as detected by the detector 50 and causes the detector 50 to conduct. At this time the light 62 is illuminated.

In practice, the computer 70 is programmed to not generate a paper "low" signal until 30 seconds after the first paper "low" signal from the detector 50. Such delay accounts for a certain amount of bounce that occurs in tray 20 as a result of the paper sheets being stripped off of the paper supply 24. The time delay selected is somewhat arbitrary as meets the needs of the specific installation and other time delays, either shorter or longer, would also suffice. Additionally, assuming that the detector 50 is so positioned that the paper "low" signal is generated when 100 sheets of paper are remaining, a counter in the computer is activated that is coupled to the paper delivery mechanism, including the roller that removes successive sheets of paper from the tray 20. The number 100, representing the number of sheets remaining as detected by the detector 50, is decremented by one with each sheet of paper that is subsequently removed. In this manner, the paper "low" signal from the detector 50 is supplemented with a paper "supply exhausted imminent" signal that may be pegged to a selected number of sheets remaining, such as, for example, ten. Since the detector 50 actually senses when a selected number of sheets is remaining, even if the tray 20 was not fully replenished at the time of the last resupply, the paper "supply exhausted imminent" signal is always accurate.

The printer 64 may be supplied to the end user with the detector 50 installed as indicated in FIGS. 2 and 2*a*. Alternatively, an existing printer 64 may be readily retrofitted to include the low level detector 50 simply by cutting the detector aperture 40 and the oval slots 42 and the rear wall 32 of the printer cassette receiver 30 and installing the detector 50 therein. Certain paper cassettes 10 as presently available on the market do not include the slot 18 in the rear wall 12 thereof. The detector 50 needs to be able to illuminate the edges of the paper supply 24 in order to be able to generate a paper "low" signal. Accordingly, in order to retrofit detector 50 into a printer 64 it may be necessary to form a slot 18 in the rear wall 12 of the paper cassette 10 if suchg slot 18 is not included in the manufacture thereof.

Although a certain preferred embodiment has been shown and described, it should be understood that many changes and modifications could be made therein without departing from the scope of the appended claims.

We claim:

1. An improved image producing device having a cabinet, the improvement comprising:

a tray cassette bearing a supply of paper sheets being removably disposed within a cassette receiver defined in the cabinet; and detector means for detecting a selected quantity of paper sheets in the tray cassette, the detector means being disposed within the cabinet.

2. An improved image producing device as claimed in claim 1 wherein the tray cassette has a rear wall, two opposed side walls and a front wall and the cassette receiver has a rear wall and two opposed side walls, the detector means being disposed in the rear wall of the cassette receiver.

3. An improved image producing device as claimed in claim 2 wherein the rear wall of the tray cassette has a slot defined therein, said slot exposing the edges of a portion of the supply of paper sheets borne within the tray cassette.

4. An improved image producing device as claimed in claim 3 wherein the rear wall of the tray cassette abuts the rear wall of the cassette receiver, the detector means being disposed opposite said slot defined in the rear wall of the tray cassette.

5. An improved image producing device as claimed in claim 4 wherein the detector means detects the edge portion of the supply of paper sheets exposed within said slot.

6. An improved image producing device as claimed in claim 5 wherein the detector means is an electro optical sensor having a light emitter and a light sensor, the light illuminator illuminating the edge portion of the supply of paper sheets and the light sensor sensing the light reflected therefrom.

7. An improved image producing device as claimed in claim 6 wherein the detector means is fully contained within the cabinet, whereby the detector means is not intrusive into the tray cassette.

8. An improved paper image reproduction device having a cabinet, the cabinet having at least one cassette receiver for receiving a paper cassette and having a paper cassette paired with each such paper cassette receiver, each of said paper cassettes bearing a supply of stacked paper sheets, the improved paper image reproduction device being communicatively integrated into a communications network, including a plurality of work stations, the improvement comprising;

detector means disposed within the cabinet for sensing a partial supply of paper in each such paper cassette; and signal generation means operably coupled to the detector means and being operably communicatively coupled to the communications network for providing a signal to the local area network representative of a partial supply of paper in each such paper cassette, whereby the communications network communicates such signal to at least one work station on the communications network.

9. An improved paper image reproduction device as claimed in claim 8 wherein said sensing means comprises a light emitter and a light sensor, the light emitter being disposed to illuminate an edge of the supply of stacked paper sheets and the light sensor being disposed to receive reflected light from the edge of the supply of stacked paper sheets.

10. An improved paper image reproduction device as claimed in claim 9 wherein said sensing means is disposed within the cabinet in a selected position relative to the cassette such that the sensing means senses when a selected number of paper sheets remains in the cassette.

11. An improved paper image reproduction device as claimed in claim 10 being in communication with a computer wherein the number of paper sheets remaining in the cassette is decremented by the computer for each sheet removed from the cassette subsequent to the sensing means' sensing when the selected number of paper sheets remains in the cassette.

12. An improved paper image reproduction device as claimed in claim 9 wherein said sensing means light emitter and a light sensor are in an adjacent disposition, oriented to emit and receive along substantially parallel paths.

13. An improved paper image reproduction device as claimed in claim 9 wherein said sensing means is positionably adjustable with respect to the cassette to select the number of sheets remaining in the cassette that is sensed.

14. An improved paper image reproduction device as claimed in claim 9 wherein said paper cassette is removable from said paper cassette receiver without affecting the disposition of the light emitter and the photodetector.

15. In a communications network having at least one work station and a plurality of paper reproduction devices operably communicatively coupled to a central processor, each of such paper reproduction devices having at least one removable paper cassette containing a supply of stacked paper sheets, a paper low detector, comprising:

detector means disposed relative to each such paper cassette for sensing a partial supply of paper in each such paper cassette; and signal generation means operably coupled to the detector means and being operably communicatively coupled to the communications network for providing a signal to the communications network representative of a partial supply of paper in each such paper cassette, whereby the communications network communicates such signal to at least one work station on the communications network.

16. A paper low detector as claimed in claim 15 wherein said detector means comprises a light emitter and a light sensor, the light emitter being disposed to illuminate an edge of the supply of stacked paper sheets and the light sensor being disposed to receive reflected light from the edge of the supply of stacked paper sheets.

17. A paper low detector as claimed in claim 16 wherein said detector means is disposed in a selected position relative to the cassette such that the sensing means senses when a selected number of paper sheets remains in the cassette.

18. A paper low detector as claimed in claim 17 being in communication with a computer wherein the number of paper sheets remaining in the cassette is decremented by the computer for each sheet removed from the cassette subsequent to the sensing means' sensing when the selected number of paper sheets remains in the cassette.

19. A paper low detector as claimed in claim 16 wherein said detector means light emitter and a light sensor are in an adjacent disposition, oriented to emit and receive along substantially parallel paths.

20. A paper low detector as claimed in claim 16 wherein said detector means is positionably adjustable with respect to the cassette to select the number of sheets remaining in the cassette that is sensed.

21. A low paper detector as claimed in claim 16 wherein said paper cassette is removable from an associated paper cassette receptacle without affecting the disposition of the light emitter and the photodetector.

* * * * *